US006969249B2

(12) United States Patent
Marino et al.

(10) Patent No.: US 6,969,249 B2
(45) Date of Patent: Nov. 29, 2005

(54) AGGREGATE DRYER BURNER WITH COMPRESSED AIR OIL ATOMIZER

(75) Inventors: John A. Marino, Lebanon, PA (US); James J. Feese, Elizabethtown, PA (US); Raymond F. Baum, Lebanon, PA (US)

(73) Assignee: Hauck Manufacturing, Inc., Lebanon, PA (US)

( * ) Notice: Subject to any disclaimer, the term of this patent is extended or adjusted under 35 U.S.C. 154(b) by 40 days.

(21) Appl. No.: 10/428,494

(22) Filed: May 2, 2003

(65) Prior Publication Data

US 2004/0219466 A1 Nov. 4, 2004

(51) Int. Cl.[7] ..... F23D 11/10
(52) U.S. Cl. ..... 431/9; 431/182; 431/187
(58) Field of Search ..... 431/9, 115, 182–184, 431/187, 189, 284, 285, 347; 34/137; 432/111; 366/25

(56) References Cited

U.S. PATENT DOCUMENTS

| | | | | |
|---|---|---|---|---|
| 3,254,846 | A | | 6/1966 | Schreter et al. |
| 3,572,963 | A | | 3/1971 | Marino |
| 3,572,967 | A | | 3/1971 | Schreter et al. |
| 3,909,188 | A | | 9/1975 | Velie |
| 4,011,995 | A | | 3/1977 | Krause, Jr. |
| 4,298,337 | A | | 11/1981 | Butler et al. |
| 4,559,009 | A | | 12/1985 | Marino et al. |
| 4,867,572 | A | * | 9/1989 | Brock et al. ..... 366/25 |
| 5,192,204 | A | | 3/1993 | Musil |
| 5,203,693 | A | * | 4/1993 | Swanson ..... 432/110 |
| 5,240,410 | A | | 8/1993 | Yang et al. |
| 5,259,755 | A | | 11/1993 | Irwin et al. |
| 5,415,539 | A | | 5/1995 | Musil |
| 5,700,143 | A | | 12/1997 | Irwin et al. |
| 5,782,626 | A | | 7/1998 | Joos et al. |
| 5,813,847 | A | | 9/1998 | Eroglu et al. |
| 5,993,199 | A | * | 11/1999 | Safarik ..... 431/284 |
| 6,048,197 | A | | 4/2000 | Beiler |
| 6,260,773 | B1 | | 7/2001 | Kamath |
| 6,488,496 | B1 | | 12/2002 | Feese et al. |
| 6,652,268 | B1 | * | 11/2003 | Irwin et al. ..... 431/284 |

FOREIGN PATENT DOCUMENTS

JP 4 124 519 A2 4/1992

* cited by examiner

*Primary Examiner*—Sara Clarke
(74) *Attorney, Agent, or Firm*—McNees Wallace & Nurick LLC

(57) ABSTRACT

A swirl-type internal flame recirculation burner apparatus and method as used to fire asphalt plant aggregate dryers, air heaters and calcining kilns and method includes a compressed air oil atomizer assembly. The burning and swirling fuel and primary main combustion air mixture recirculates upstream along the burner axis. The secondary main combustion air may be swirled. The burner may also be fired on gas or a combination of gas and oil.

7 Claims, 5 Drawing Sheets

AGGREGATE DRYER BURNER WITH COMPRESSED AIR OIL ATOMIZER

FIELD OF THE INVENTION

The present invention is generally directed to a burner used for drying aggregate in a rotary dryer and a rotary dryer system and specifically to burners used for asphalt applications.

BACKGROUND OF THE INVENTION

U.S. Pat. No. 4,559,009, issued Dec. 17, 1985, assigned to Hauck Manufacturing Co. of Lebanon, Pa., and which is incorporated herein by reference, discloses a conventional aggregate dryer burner known in the art. The prior art burner, which uses a low pressure air oil atomizer, depends solely on a main combustion air blower to generate the pressure required to atomize fuel oil.

While this prior art burner generally works well, the 50-cycle air blowers found in many areas of the world produce air having a pressure of 24 osig. Air supplied at 24 osig air from a 50-cycle blower works well with the conventional aggregate dry burner for light oils, but 24 osig air does not effectively burn heavier oils. In order to achieve a higher burner discharge pressure of about 2 to 2.25 psig necessary to properly combust the heavier oils, since a 60-cycle blower cannot readily be adapted for use in these parts of the world, the air blower has to be mechanically altered to produce higher pressure air.

Compressed air oil atomizers and flame stabilization are also well known in the art. One type of compressed air oil atomizer, used in a burner in which 100 percent of the combustion air is provided through the burner assembly, is disclosed in Reissue application Ser. No. 10/387,006, filed Mar. 12, 2003, which originally issued as U.S. Pat. No. 6,488,496 B1, issued Dec. 3, 2002 (the "'006" Application), which is assigned to Hauck Manufacturing Co. of Lebanon, Pa. and which is hereby incorporated by reference. As taught in the '006 Application, primary air is generally supplied to the burner at a pressure of 36 osig.

What is needed is a burner assembly and method that permits the use of heavy oil with lower pressure main combustion air produced by 50-cycle power sources as are found in many areas of the world for air blowers.

SUMMARY OF THE INVENTION

The present invention is a swirl-type internal flame recirculation burner with a compressed air oil atomizer assembly that is suitable for operation with oil, gas, liquid propane, or combinations of oil and gas, oil and liquid propane, and liquid propane and gas for use with blowers producing insufficient pressure to completely combust oils. The invention relates to heating burners of the type used in asphalt plants to heat and dry aggregate prior to mixing with tar to form paving asphalt, to heat air or to heat calcinating kilns.

In order to obtain a higher level of energy than that which is readily provided by a lower pressure blower for atomizing and mixing the heavier fuel oils typically used in the production of aggregate for asphalt paving, another source of higher pressure air has to be used in order for the burner atomizer to generate sufficient discharge pressure to effectively atomize the oil. The higher level of energy for atomization is provided from a separate source of compressed air rather than from the lower pressure main combustion air source. With the use of compressed air, the main combustion air blower can then be selected to operate at a lower pressure when using any type of fuel oil, including heavier fuel oils, and with natural gas and liquid propane.

The burner assembly divides main combustion air into two flows, primary main combustion air and secondary main combustion air. The main combustion air from the main combustion air source, in addition to the compressed air, provides about 30 percent to about 40 percent of the total air for combustion. The remaining air for combustion is provided from the ambient environment through induction of air around the burner from an induced draft at the downstream end of the process.

The various tubes and passages of the burner assembly of the present invention, which are required for proper combustion, flame shape, and flame position, are generally nested within one another. The outermost passage is a secondary air passage, through which most of the main combustion air from the main combustion air source is flowed and swirled. The main combustion air that is flowed through this secondary air passage is known as secondary main combustion air. The secondary main combustion air may be swirled by flowing the secondary main combustion air through a secondary swirl vane assembly, which imparts swirl to the secondary main combustion air. Such swirl vane assemblies are well known in the art. A primary air passage, through which a portion of the main combustion air is flowed and swirled, is nested within the secondary air passage. A compressed air tube, through which the compressed air is flowed, and a compressed air oil atomizer, through which the compressed air and oil pass and through which the oil is atomized, is nested within the primary air passage. The primary main combustion air is swirled by flowing the primary main combustion air through a plurality of swirl vanes attached to the compressed air oil atomizer and positioned adjacent to an interior wall of the primary air passage. The primary swirl vanes impart swirl to the primary main combustion air.

While the secondary air passage, the primary air passage, the compressed air tube, and the oil tube are preferably coaxially arranged, such a coaxial arrangement along the entire length of the secondary air passage, the primary air passage, the compressed air tube, and the oil tube, is not required. The compressed air and the oil tube must be arranged so that compressed air and oil enter the compressed air oil atomizer substantially coaxially. The primary main combustion air passage and the secondary main combustion air passage must be arranged so that primary main combustion air and the secondary main combustion air exit the burner substantially coaxially.

The secondary main combustion air has a swirl number, which is the ratio of tangential momentum to axial momentum, proportional to the required flame geometry. The higher the swirl number of the secondary main combustion air, the shorter and wider the combustion flame. When the swirl number of the secondary main combustion air is greater than 0.6, flame recirculation causes the flame to become relatively short and bushy. When the swirl number of the secondary main combustion air is less than 0.6, the flame is longer and narrower.

Flame stabilization results from two concentric streams, the inner concentric stream, which is the compressed air and atomized fuel and the outer concentric stream, which is the primary main combustion air. The primary main combustion air is provided from a main combustion air blower and is swirled so that the swirl number of the primary main combustion air is above a critical swirl number of 0.6. The inner stream of air, which is at a higher pressure than main combustion air, is provided from a separate source of compressed air, which is independent of the main combustion air blower and is swirled as it passes through the compressed air oil atomizer assembly. Such sources of compressed air are often found in physical plants and are known in the art.

The compressed air oil atomizer also includes a bluff body attached to its end in order to created bluff body recirculation to hold the flame in position. The bluff body may assume any convenient geometric shape, so long as it creates a negative pressure around the atomizer.

A frusto-conical metal flame holder may surround the burner nose. The flame holder has two primary functions, namely to serve as a heat shield and as a flame shaping tool.

At a high burn rate, more compressed air and oil is supplied to the compressed air oil atomizer assembly than at low-bum. In general, a constant volume of ambient air for combustion is drawn past the flame holder and into the combustion zone by a process referred to as induction. This air further mixes with the unburned, atomized fuel in the flame to complete combustion of the fuel. At high-burn rates, the burner of the present invention, depending on the size of the burner, may have output of about 27 million to about 200 million btu per hour. The output of the burner is continuously adjustable between high and low burn rates by varying fuel and airflow.

The optional secondary air swirl vane assembly may include a radial swirl vane assembly or an axial swirl vane assembly. Such swirl vane assemblies are well known to the art. The swirl number of the secondary main combustion air may be adjusted by adjusting the swirl vane assembly to change the shape of the flame. For some burner situations where the necessary shape of the flame is known and where the secondary swirl vane assembly is present, the swirl of the secondary air may be preset by fixing the swirl vane in a single fixed position whereby it is not adjustable.

The present invention is also directed to a portable rotary aggregate dryer system wherein the burner of the present invention is associated with a centrifugal blower and dryer. The blower, dryer and burner are mounted on a suitable frame. Such blowers, dryers and burners are well known in the art. The centrifugal blower may be of the type disclosed in U.S. Pat. Nos. 3,572,963, issued Mar. 30, 1971, and 3,572,967, issued Mar. 30, 1971, which are assigned to Hauck Manufacturing Co. of Lebanon, Pa. and which are hereby incorporated by reference. While these blowers produce higher-pressure air when they are run using a 60-cycle power source, they produce lower pressure air when they are run using a 50-cycle power source. The present invention allows the lower pressure air produced by the blowers using a 50-cycle power source to be used to provide main combustion air. In addition to permitting the lower pressure air produced by the blowers to be supplied by a blower connected to a 50-cycle power source, the present invention also allows less powerful blowers to be attached to a 60-cycle power source. Generally, the present invention requires 40 percent less horsepower for the blowers when a 60-cycle power source is used. The present invention allows main combustion air to be supplied in a range of about 22 to about 28 osig rather than the previously required main combustion air pressure of about 36 osig.

The present invention is also directed to a method for promoting rapid mixing of fuel and air and for obtaining a stable combustion flame in a burner. The method comprises providing compressed air to atomize oil, particularly heavy oil, for combustion, providing atomized oil for combustion, providing bluff body recirculation of at least the compressed air and atomized oil, providing a portion of air for combustion as main combustion air from within the burner, the main combustion air being provided at a pressure of at least 22 osig and inducing a portion of air for combustion from outside of the burner.

An advantage of the present invention is that when the burner is fired on oil, it can function effectively using a lower pressure air blower operating in the range of about 22 osig to about 28 osig, operating at a horsepower in the range of about 15 hp to about 60 hp, and providing air at a rate of about 1500 cfm to about 7500 cfm. Thus, a lower pressure air blower can be used effectively regardless of the grade and weight of the oil.

Another advantage of the present invention is that the reduction in pressure required from the main combustion air blower, even at 60-cycle operation, lowers the horsepower requirements of the blower, which results in cost savings, as smaller more energy efficient blowers can be utilized.

Other features and advantages of the present invention will be apparent from the following more detailed description of the preferred embodiment, taken in conjunction with the accompanying drawings which illustrate, by way of example, the principles of the invention.

IN THE DRAWINGS

DETAILED DESCRIPTION OF THE INVENTION

Figure 1:
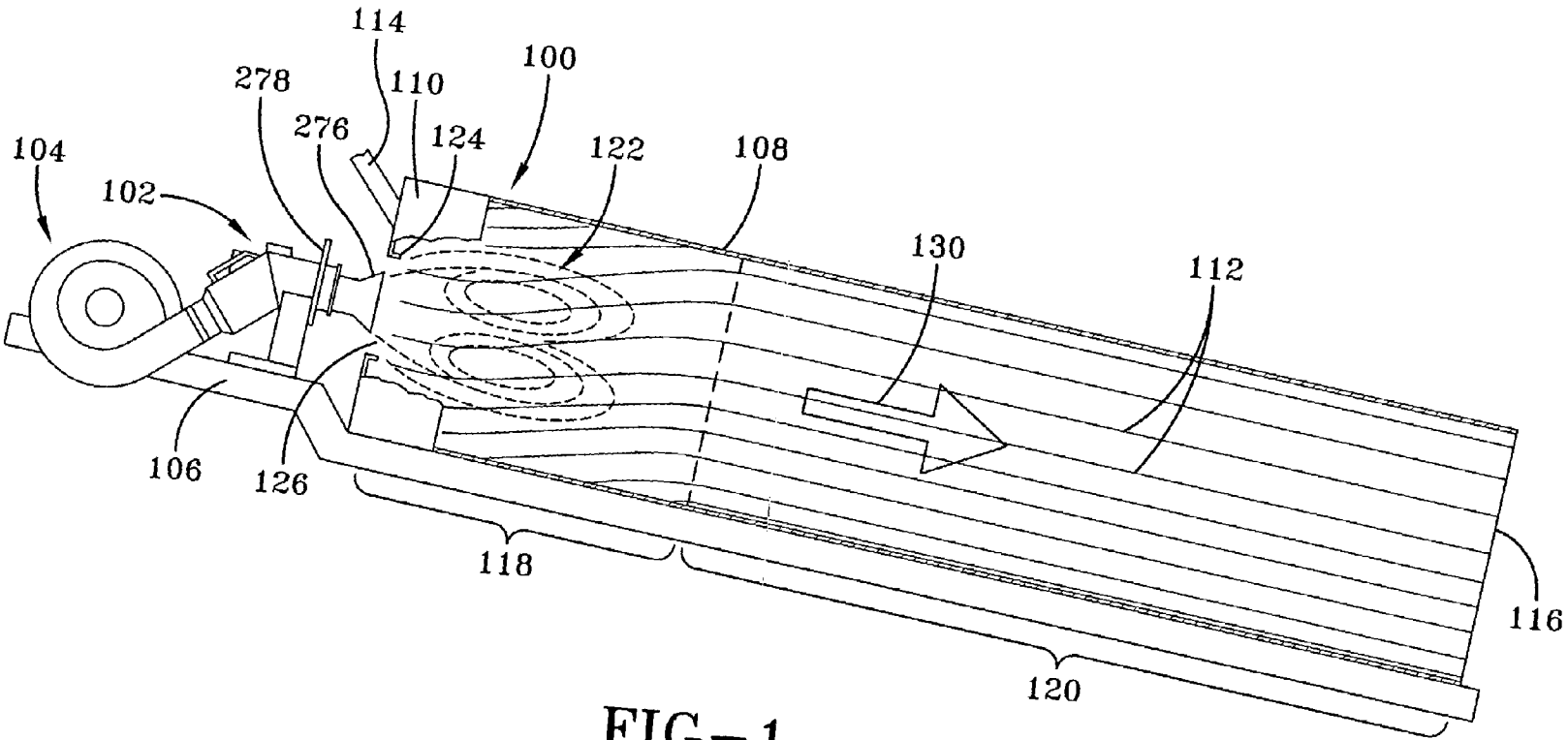
FIG. 1 is a side view, partial cross-section, of an aggregate drying drum using a burner according to the present invention.

FIG. 1 schematically illustrates one type of portable rotary aggregate dryer 100 of the type used to dry and preheat aggregate for mixing with a petroleum base material in the manufacture of paving asphalt heated by a burner of the present invention. The dryer 100 is heated by burner 102, which includes a main combustion air supply, such as centrifugal blower 104 for supplying combustion air to the burner. Other types of main combustion air supplies are readily available and are well known in the art. The blower preferably produces air at a pressure in the range of about 22 osig to about 28 osig. In a most preferred embodiment, the blower produces air at about 24 osig. The dryer 100, burner 102 and blower 104 are all mounted on a suitable frame 106.

Figure 2:
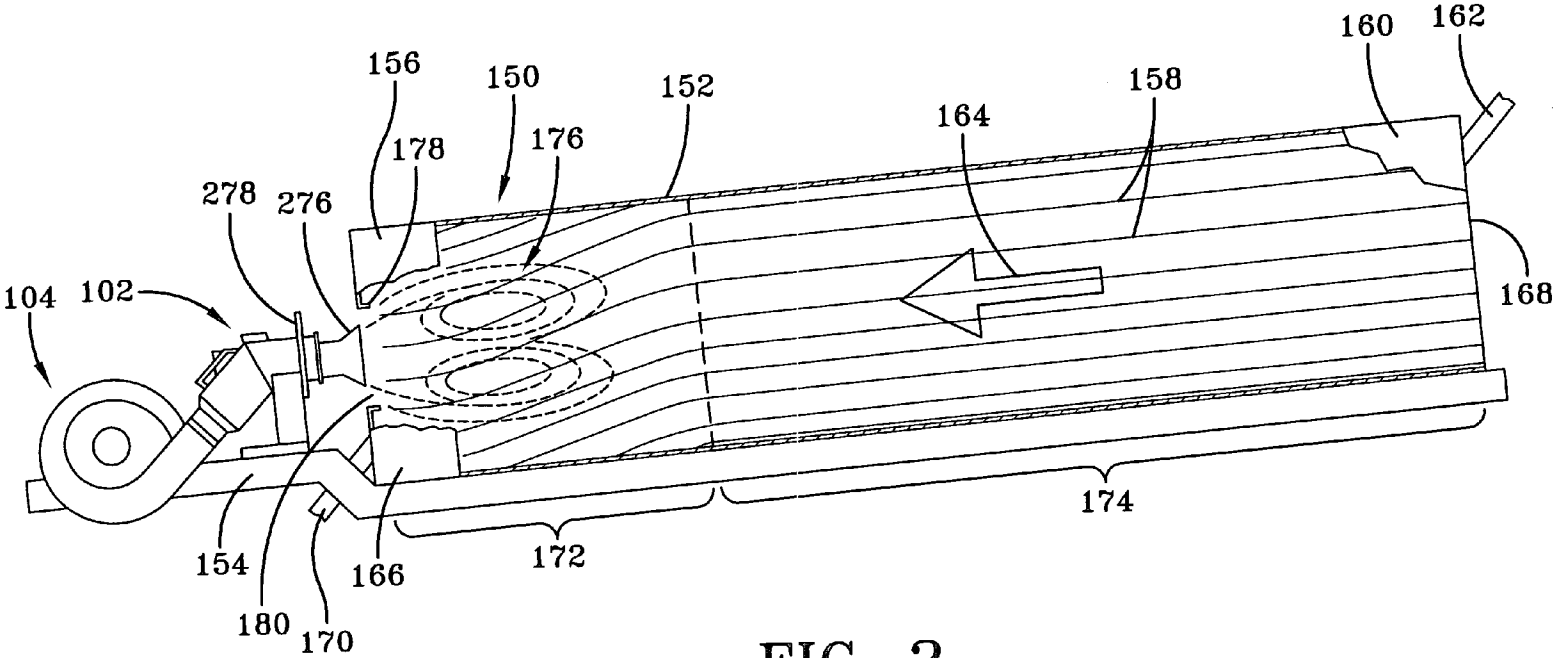
FIG. 2 is a side view, partial cross-section, of a counterflow aggregate drying drum using a burner according to the present invention.

FIG. 2 schematically illustrates another type of portable rotary aggregate dryer, a counterflow dryer 150, of the type used to preheat aggregate for mixing with a petroleum base material in the manufacture of paving asphalt heated by a burner of the present invention. The dryer 150 is heated by burner 102, which includes a main combustion air supply, such as centrifugal blower 104 for supplying combustion air to the burner. Other types of main combustion air supplies are readily available and are well known in the art. The blower preferably produces air at a pressure in the range of about 22 osig to about 28 osig. In a most preferred embodiment, the blower has a size of about 15 hp to about 60 hp, has an output in the range of about 1500 cfm to about 7500 cfm and produces air at about 24 osig. The dryer 150, burner 102 and blower 104 are all mounted on a suitable frame 154.

Figure 3:
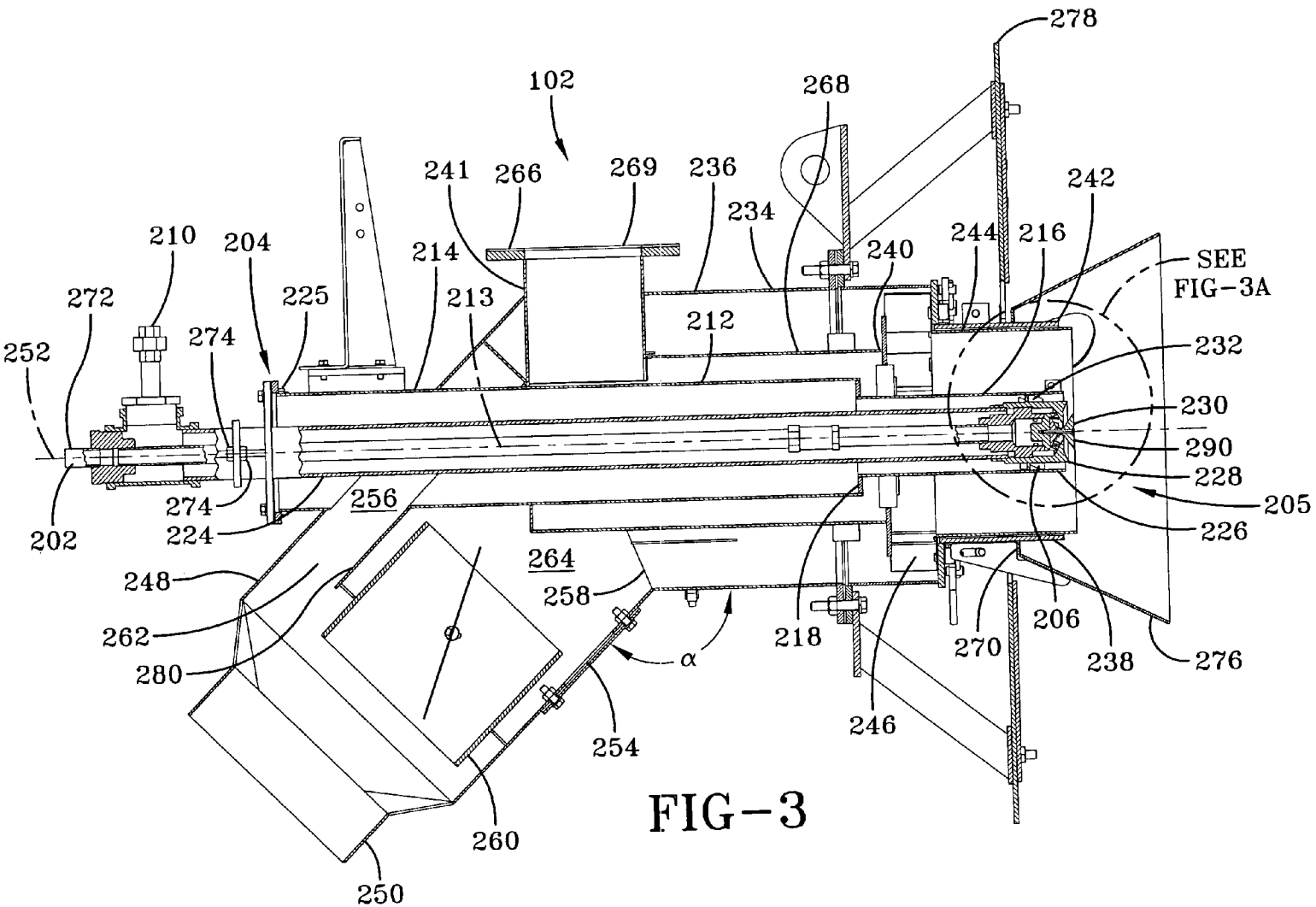
FIG. 3 is a partial cross-section view of one embodiment of the burner of FIGS. 1 and 2.
Figure 3A:
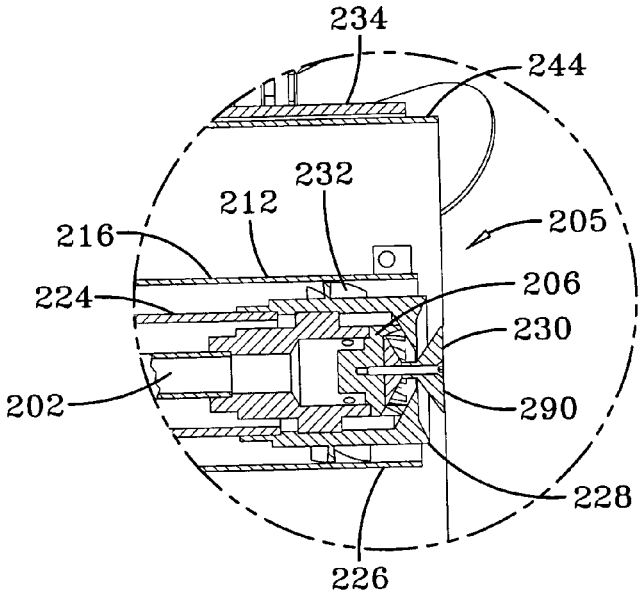
Figure 4:
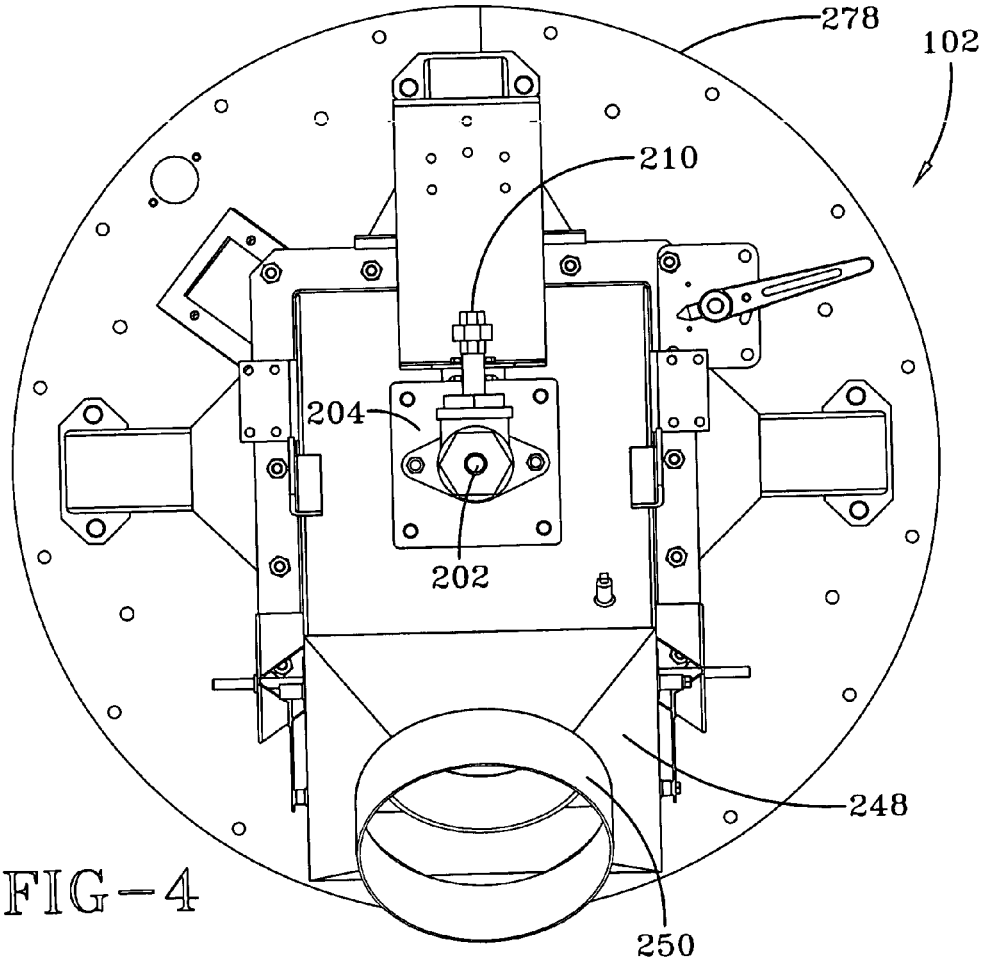
FIG. 4 is a perspective and partial section view of the upstream end of one embodiment of the burner of FIGS. 1 and 2.

As illustrated in FIGS. 3 and 3A and FIG. 4, burner 102 includes a fuel oil pipe 202, in fluid communication with the supply of fuel oil (not shown), leading from the upstream end 204 of the primary air passage 212 to compressed air oil atomizer assembly 206 located at the downstream end of the primary air passage 212. Preferably, fuel oil pipe 202 extends axially through the burner. A compressed air inlet 210 provides compressed air from a compressed air source to the compressed air tube 224, also leading from the upstream end 204 of the primary air passage 212 to compressed air oil atomizer assembly 206 and preferably extending coaxially with fuel oil pipe 202 through at least a portion of burner 102. The compressed air is provided at a pressure in the range of about 15 psig to about 100 psig and can be regulated as desired by a pressure regulator. In a preferred embodiment, the compressed air is provided at a pressure of about 60 psig. In this embodiment, the fuel oil pipe 202 is nested coaxially within the compressed air tube 224. In a preferred embodiment, the fuel oil pipe 202 and the compressed air tube 224 are coaxially arranged, however, the invention is not so limited.

About 25 percent to about 50 percent of the combustion air is provided from the compressed air source and the main combustion air source, and preferably about 30 percent to about 40 percent of the combustion air is provided from the compressed air source and the main combustion air source. The remaining combustion air is provided from the ambient environment by induction of air into the combustion flame.

A primary air passage 212 provides primary main combustion air for combustion and is associated with a main combustion air supply such as a centrifugal blower 104. The compressed air tube 224 and the fuel oil pipe 202 preferably are nested within the primary air passage 212. In the preferred embodiment, wherein secondary main combustion air is swirled using a secondary swirl vane assembly 246 that imparts a radial component of swirl to the secondary main combustion air traveling in a primarily radial direction, and which will hereinafter be referred to as a "radial secondary swirl vane assembly," the primary air passage 212 extends from a first upstream end 225 to a second downstream end 226 and has two sections, an upstream section 214 and a downstream section 216. In a preferred embodiment, the primary air passage 212, the fuel oil pipe 202, and the compressed air tube 224 are coaxially arranged. The upstream section 214 of primary air passage 212 extends from the upstream end 225 of primary air passage 212 in a downstream direction to radially inward step 218, which places the upstream section 214 of primary air passage 212 in fluid communication with the downstream section 216 of primary air passage 214. The downstream section 216 of primary air passage 212 extends downstream from the inward step 218 to the downstream end 226 of primary air passage 212. The inward step produces the cross-sectional change, but the change in cross-sectional area is not so limited, as it may be produced by any convenient method such as a gradual or rapid taper. In a preferred embodiment, the upstream section 214 has a larger cross-sectional area than the downstream section 216. The compressed air oil atomizer assembly 206 is fitted within the downstream end 226 of primary air passage 212. In a preferred embodiment, the downstream end 228 of atomizer assembly 206 extends a short distance downstream from and beyond the end 226 of primary air passage 212. In a more preferred embodiment, the atomizer assembly 206 includes means for adjusting, such as atomizer adjusting nuts 274, which may be adjusted to accomplish axial adjustment of the atomizer assembly 206. In a more preferred embodiment, the downstream end 228 atomizer assembly 206 extends in the range of about 0 inches to about ½ inch beyond the downstream end 226 of primary air passage. In a most preferred embodiment, the downstream end 228 of atomizer assembly 206 extends about 3/16 inch beyond the downstream end 226 of primary air passage 212. In a preferred embodiment, the atomizer assembly 206 is axially adjustable. In another embodiment, where the secondary main combustion air is swirled using another type of secondary swirl vane assembly that imparts a radial component of swirl to the secondary main combustion air traveling in a substantially axial direction, and which will hereinafter be referred to as an "axial secondary swirl vane assembly," the primary air passage 212 has one section.

A plurality of primary swirl vanes 232 are attached to the atomizer 206 and positioned within primary air passage 212, extending adjacent to the interior surface of the primary air passage 212. The primary swirl vanes 232 impart a swirl to the primary main combustion air as it flows through the primary air passage 212, the vanes extending radially inward into air passage 212 and at a preselected angle with an axis 213 of the primary air passage 212. The primary main combustion air exiting the primary air passage 212 has a swirl number of about 0.6 or greater. In a preferred embodiment, the primary main combustion air has a swirl number of about 0.7 to about 1.1. In a most preferred embodiment, the primary main combustion air has a swirl number of about 0.9.

As is known in the art, a swirl number, S', for a swirling annular flow of gases must be greater than 0.6 to achieve internal recirculation. The characteristics of swirl flames are discussed at Chapter 5, pp. 100–146 of Beer and Chigier, Combustion Aerodynamics (Halsted Press Division, John Wiley & Sons, Inc., 1972), which is herein incorporated by reference.

Fuel oil is delivered to atomizer 206 at about the same pressure as the compressed air since the compressed air and the oil have to be at approximately the same pressure in an internal chamber (not shown) of the atomizer 206 in order for the atomizer to function properly. Such an internal chamber is well known in the art. The pressure of the fuel oil is first increased in a separate assembly (not shown) before being delivered to fuel oil pipe 202. The atomized oil and air exits the compressed air atomizer 206 as at least one jet of finely divided droplets of oil and air. In a preferred embodiment, the atomized oil exits the compressed air atomizer 206 as a plurality of jets of finely divided oil particles in air.

A bluff body 290 positioned at the end of the atomizer 206 assists in holding the burner flame in place through the creation of a negative pressure zone downstream of the atomizer 206. Bluff bodies positioned at the end of compressed air oil atomizers are well known in the art. In a preferred embodiment, the bluff body 290 is a diverging tip 230.

In an optional embodiment, the main combustion air is provided through a single main combustion air passage instead of through both a primary air passage and a secondary air passage. A unitary end cap comprising of swirl vanes and a bluff body is placed over the downstream end of the main combustion air passage.

A secondary air passage 234 provides secondary main combustion air for combustion and is associated with a main combustion air supply such as a centrifugal blower 104. The compressed air tube 224, the fuel oil pipe 202, and the primary air passage 212 are nested within the secondary air passage 234. The secondary main combustion air does not have to be swirled in order for the burner 102 to function properly, and secondary swirl vanes are an optional component.

In a preferred embodiment, wherein the secondary main combustion air is swirled using a radial secondary swirl vane assembly 246, the secondary air passage 234 extends from a first upstream end 241 of secondary air passage 234 to a second downstream end 242 of secondary air passage 234 and has two sections, an upstream section 236 and a downstream section 238. In a preferred embodiment, the secondary air passage 234, the primary air passage 212, the fuel oil pipe 202, and the compressed air tube 224 are coaxially arranged. The upstream section 236 of secondary air passage 234 extends from a first upstream end 241 of secondary air passage 234 in a downstream direction to radially inward step 240, which places the upstream section 236 of secondary air passage 234 in fluid communication with the downstream section 238 of secondary air passage 234. The downstream section 238 of secondary air passage 234 extends axially in the downstream direction from the step 240. In a most preferred embodiment, the upstream section 236 has a larger cross-sectional area than the downstream section 238. In a preferred embodiment, the downstream end 226 of the primary air passage 212 is flush with the downstream end 242 of secondary air passage 234. As with the primary air passage, the change in cross-sectional area need not be limited by presence of step 240. In another embodiment, wherein the secondary main combustion air is swirled using axial secondary swirl vanes (not shown), the secondary air passage 234 has one section.

Figure 5:
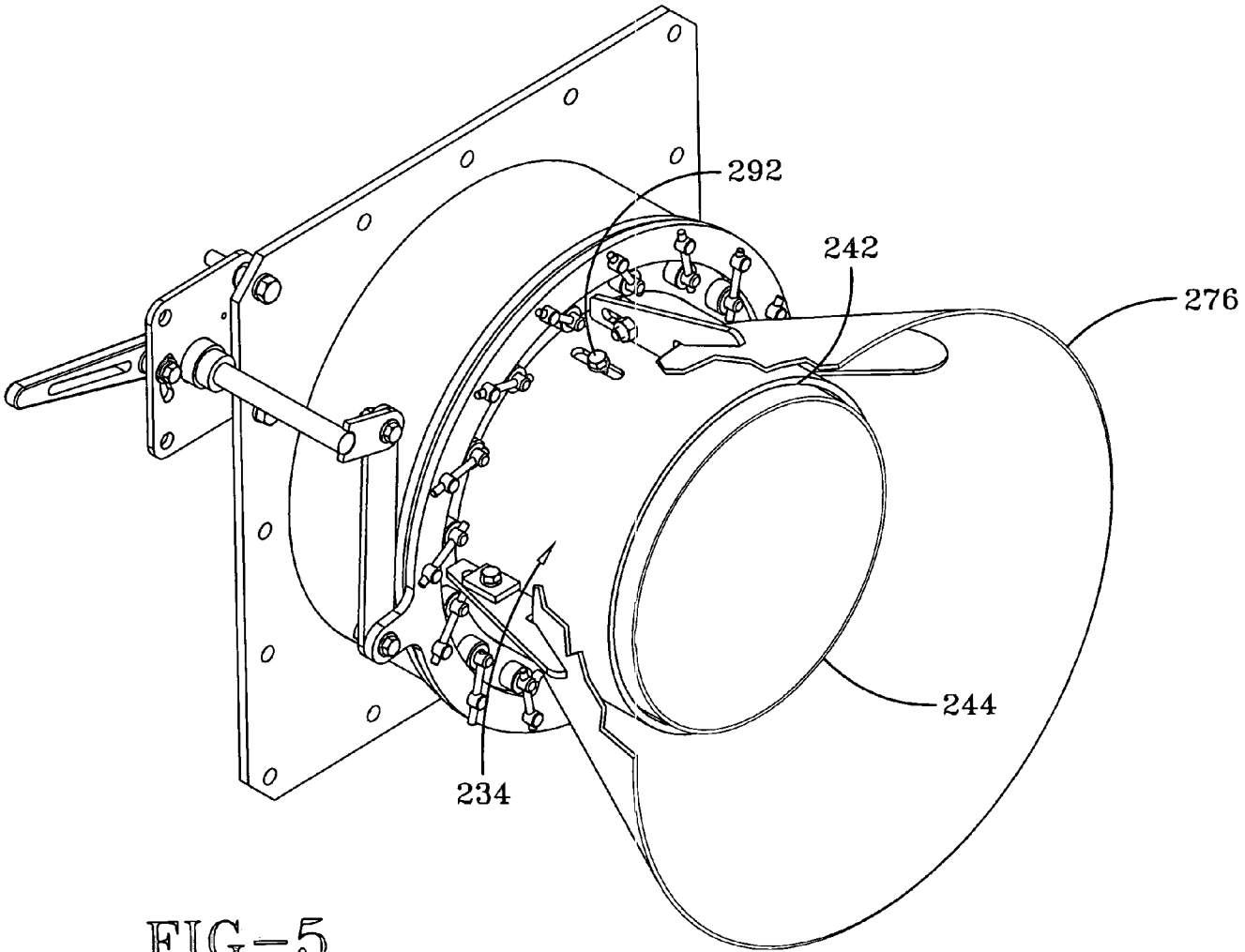
FIG. 5 is a perspective and partial section view of the downstream end of one embodiment of the burner of FIGS. 1 and 2.

In an optional embodiment, a secondary air sleeve 244 is positioned within the secondary air passage 234, reducing the cross-sectional area of the secondary air passage 234. In an optional embodiment, the downstream end 242 of secondary air passage 234 extends axially in a downstream direction beyond the downstream end 226 of the primary air passage 212. As shown in FIG. 5, in a preferred embodiment, the secondary air sleeve 244 is attached to the secondary air passage 234 using a sleeve-locking bolt 292. The secondary air sleeve 244 is axially adjustable by adjusting the position of the secondary air sleeve 244 and sleeve-locking bolt 292 with respect to the secondary air passage 234, providing additional flame shaping capabilities.

Secondary main combustion air flows into secondary air passage 234 and through a secondary swirl vane assembly 236 and out of the secondary air passage. Swirl vane assemblies are well known in the art. The secondary swirl vane assembly 236 optionally may be made adjustable to adjust the swirl of the secondary main combustion air downstream of the secondary swirl vane assembly 236. In a preferred embodiment, the secondary swirl vane assembly produces secondary main combustion air with a swirl number in the range of about 0 to about 2.0. Such adjustable swirl vane assemblies are well known in the art. The swirl imparted to the secondary main combustion air does not have to be about or above the critical swirl number of 0.6 since the secondary main combustion air only impacts the adjustment of the length and width of the combustion flame. Swirling the secondary main combustion air also is not required as the burner functions properly even if the secondary main combustion air is not swirled, so that the swirl number can effectively be zero.

Main combustion air inlet section 248 includes an upstream mouth 250 connected to the outlet of the main combustion air supply. In a preferred embodiment, the main combustion air supply is centrifugal blower 104. The axis of main combustion air inlet section preferably intersects the axis of secondary air passage 234 to form an angle $\alpha$, which is in the range of about 90° to about 180°. In a preferred embodiment $\alpha$ is about 135°. In a more preferred embodiment, the burner 102 has a central axis 252 and a is the angle between the main combustion air inlet section 248 and the central burner axis 252. The larger the angle $\alpha$, up to 180°, the smaller the pressure drop of the main combustion air from the main combustion air source to the primary air passage 212 and the secondary air passage 234. The inlet section 248 includes a downstream duct 254 that is connected to the primary air passage 212 through an opening 256 in the primary air passage 212 and is connected to the secondary air passage 234 through an opening 258 in the secondary air passage. The inlet section 248 also includes an interior wall 280 which divides the downstream duct 254 into a primary inlet passageway 262 and a secondary inlet passageway 264. The primary main combustion air flows through the upstream mouth 250 through the primary inlet passageway 262 and into the primary air passage 212. The inlet section 248 includes a damper assembly 260 for controlling the flow of main combustion air into the secondary air passage 234. Secondary main combustion air flows through the upstream mouth 250, through the damper assembly 260, into the secondary inlet passageway. The damper assembly 260 can be adjusted to control the amount of secondary main combustion air that flows through the secondary air passage 234.

In a preferred embodiment, the burner 102 also includes a gas inlet section 266 for providing the option of firing the burner 102 on gas or on a combination of gas and oil. The gas inlet section 266 provides gas for combustion to gas passage 268 through an inlet 269 of gas passage 268. The gas that is provided to gas passage 268 at a pressure that is approximately equivalent to the pressure of the secondary main combustion air downstream of gas passage 268. The pressure of the gas is adjusted through the use of a regulator (not shown), which can be controlled by a controller (not shown). Such regulators and controllers are well known in the art. The gas is mixed with the secondary main combustion air downstream of gas passage 268. The gas passage 268 is nested within the secondary air passage 234. The primary air passage 212 is nested within the gas passage 268. In a preferred embodiment, the oil pipe 202, the compressed air tube 224, the primary air passage 212 and the secondary air passage 234 extend downstream of the gas passage 268. However, the inclusion of a gas inlet section 266 and gas passage 268 is optional and is not required for the proper operation of burner 102.

In a preferred embodiment, a frustro-conical heat shield and flame shaper 276 is mounted on the exterior of the secondary air passage 234 and surrounds the secondary air passage 234. The primary function of heat shield and flame shaper 276 is to function as a heat shield, but heat shield and flame shaper 276 is not a necessary element for proper burner 102 operation and may be omitted. The heat shield and flame shaper 276 also helps to shape the flame. In an optional embodiment, the inner end 270 of the heat shield and flame shaper 276 forms a relatively airtight seal with the secondary air passage 234. In a preferred embodiment, the heat shield and flame shaper 276 may be axially adjustable to maximize flame stability and to help shape the flame.

In a preferred embodiment, burner 102 also includes a flame shield 278 surrounding the secondary air passage 234. In a preferred embodiment, a spark-ignited pilot line (not shown) extends from a fuel source (not shown) into the heat shield and flame shaper 276 to ignite the burner flame. The pilot line can be fueled by gas or liquid propane. If the pilot line is fueled by gas, it may originate from the gas source of the gas for the burner flame. Such pilot lines are well known in the art.

The upstream end of oil pipe 272 is attached to a fuel oil delivery system (not shown), which forms part of a conventional control system (not shown) for the burner 102. This system also controls the position of the damper assembly 260 and the valve or regulator of gas inlet line (not shown).

The centrifugal blower 102 connected to the main combustion air inlet section 248 may be of the type disclosed in the U.S. Pat. Nos. 3,572,963 and 3,572,967. Other types of blowers or air sources may be used to supply combustion air to the burner.

Referring again to FIG. 1, one type of asphalt dryer 100 includes a rotary drum 108 mounted on frame 106 with an elevated fixed burner end 110. The interior surface of the drum 108 includes a plurality of aggregate flights 112 so designed that aggregate supplied to the drum end 110 by conveyor 114 moves axially down the drum 102, in the direction of arrow 130, from dryer end 110 to discharge end 116. Drum 108 typically is about 6 to about 10 feet in diameter and about 20 to about 30 feet long. During the travel of the aggregate down the drum around a flame 122, the flights 112 hold the aggregate against the interior sidewalls of the drum to prevent aggregate from falling across the interior combustion zone. Bracket 118 indicates the portion of the drum 108 where the flights 112 hold the aggregate against the interior sides of the drum 108. The actual length of bracket 118 will vary depending on the geometry of flame 122. The geometry of the flame 122 is dependent on a variety of variables, including the length and width of the drum 108. The variables that impact the geometry of the flame 122 are well known in the art. The remaining portion of the flights away from end 110 permit the aggregate to fall across the interior of the drum 108 as the drum 108 rotates. The falling aggregate forms a curtain or veil of particulate material completely filling the interior of the drum. Bracket 120 indicates the portion of drum 108 in which the aggregate falls across the interior of the drum 108. The actual length of bracket 120 will vary depending on production requirements of drum 108. The flame 122 occupies the space indicated by bracket 118 without contacting the aggregate veil.

Drum end 110 includes a breaching ring 124 surrounding the end of burner heat shield and flame shaper 276. Typically, the opening 126 within the breaching ring 124 has a diameter sufficiently large so that as the ambient combustion air flows from the ambient environment into the flame 122, it experiences a pressure drop in the range of about 0.058 osig to about 0.144 osig. In a preferred embodiment, the ambient combustion air experiences a pressure drop of about 0.116 osig. The dryer 100 includes a fan system (not illustrated), which draws air through opening 126 down the drum and out discharge opening 116. The operation of the fan system sets the air pressure in the drum 108, while the size of the opening 126 meters the flow of ambient combustion air into the flame 122 that is required to complete the combustion process.

Referring now to FIG. 2, an asphalt counterflow dryer 150 is shown, which includes a counterflow rotary drum 152 mounted on frame 154 with a lowered fixed burner end 156. The interior surface of the drum 152 includes a plurality of aggregate flights 158 so designed that aggregate supplied to the counterflow drum intake end 160 by conveyor 162 moves axially down the drum 152, in the direction of arrow 164, from end 160 to discharge end 166 and down discharge chute 170. Drum 152 typically is about 6 feet to about 8 feet in diameter and about 20 feet to about 30 feet long. The aggregate begins traveling down the drum at end 160 and first travels through section 174. The falling aggregate forms a curtain or veil of particulate material completely filling the interior of the drum 152. Bracket 174 indicates the portion of drum 152 in which the aggregate falls across the interior of the drum 152. The actual length of bracket 174 will vary depending on the production rate of the drum 152. During the travel of the aggregate down through section 172 around flame 176, the flights 158 hold the aggregate against the interior sidewalls of the drum 152 to prevent aggregate from falling across the interior combustion zone. Bracket 172 indicates the portion of drum 152 where the flights 158 hold the aggregate against the interior sides of the drum 152. The actual length of bracket 172 will vary depending on the geometry of flame 176. The geometry of the flame 176 is dependent on a variety of variables, including the length and width of the drum 152. The variables that impact the geometry of the flame 176 are well known in the art. The remaining portion of the flights away from end 166 permit the aggregate to fall across the interior of the drum 152 as the drum 152 rotates. The flame 176 occupies the space indicated by bracket 172 without contacting the aggregate veil.

Counterflow drum discharge end 166 includes a breaching ring 178 surrounding the end of burner heat shield and flame shaper 276. Typically, the opening 180 within the breaching ring 178 has a diameter sufficiently large so that as the ambient combustion air flows from the ambient environment into the flame, it experiences a pressure drop in the range of about 0.058 osig to about 0.144 osig. In a preferred embodiment, the ambient combustion air experiences a pressure drop of about 0.116 osig. The dryer 150 includes a fan system (not illustrated), which draws air through opening 180 down the drum 152 and out counterflow drum opening 168. The operation of the fan system sets the air pressure within the drum, while the size of the opening 180 meters the flow of ambient combustion air into the flame 176 that is required to complete the combustion process.

During operation of the burner, the ratio of main combustion air that is provided as primary main combustion to the ratio of main combustion air that is provided as secondary main combustion air is generally in the range of about 1:8 to about 1:12. In a preferred embodiment, this ration is about 1:10. Adjusting the damper 260 controls this ratio. The damper 260 is never completely closed.

At low burn, the flame is considerably reduced over high-burn flame 122 shown diagrammatically in FIG. 1 and high-burn flame 176 shown diagrammatically in FIG. 2. The frustro-conical heat shield and flame shaper 276, which is angled from the axial burner axis at an angle in the range of about 20° to about 35° aids in shaping and holding the flame on the burner head while, at the same time, guiding ambient air flowing into the drum from outside the burner through opening 124 away from direct contact with the flame. Such contact would tend to elongate, cool and destabilize the flame. This is particularly a problem in the case of certain types of aggregate dryers where the flow of ambient air into the combustion region through induction is not reduced when the burner is turned to a low heat. In a preferred embodiment, the heat shield and flame shaper 276 is angled from the burner axis 252 at about 25°.

The present invention also includes a novel method for promoting rapid mixing of fuel and air and for obtaining a stable combustion flame in a burner. The method comprises providing compressed air to both atomize oil and support combustion, providing atomized oil for combustion, providing bluff body flame stabilization at the tip of the atomizer assembly, providing a portion of air for combustion as main combustion air from within the burner, the main combustion air being provided at a pressure in the range of about 22 osig to about 28 osig, while inducing a portion of air for combustion from outside of the burner. In an optional embodiment, the present invention includes supplying gas for combustion.

In a preferred embodiment, the primary main combustion air is provided at about 24 osig. When 24 osig air is supplied as main combustion air through the burner of the present invention, supplying about 40 percent of the total air for combustion, the heat output for the burner, depending on the size of the burner, will be in the range of about 23 million btu per hour to about 100 million btu per hour. In order to achieve such an amount of heat output, the 40 percent of the total air for combustion must be supplied at about 1500 cfm to about 7500 cfm. The horsepower required to supply such a rate of main combustion air is in the range of about 15 hp to about 60 hp. In the prior art burner, such heat output range would require blowers having horsepower in the range of about 25 to about 100 to generate the same result.

In a preferred embodiment, the method of the present invention includes providing about 60 percent to about 70 percent of the air for combustion from the ambient environment outside the burner.

In a preferred embodiment, the main combustion air is provided in two separate streams of air, namely primary main combustion air and secondary main combustion air through two separate passages. The primary main combustion air is swirled so that it exits the burner 102 having a swirl number of at least about 0.6. The secondary main combustion air does not have to be swirled, but can be swirled to adjust the flame shape. The swirl number of the secondary main combustion air may be fixed or variable. The secondary main combustion air mixes with radially expanding and more highly swirled primary main combustion air and atomized oil streams so that the flows actively intermingle and further promote fuel atomization and flame stabilization. The primary main combustion air is recirculated axially back toward the burner creating a quiescence, or zero velocity, zone where the flame anchors to provide stability. This recirculation occurs even if the secondary main combustion air swirl number is not swirling. Ambient air is induced into the combustion region through induction and mingles with the primary and secondary flows.

As the swirling, compressed air and oil mixture and primary main combustion air flows leave the mouth of the primary air passage and the compressed air oil atomizer, the two streams expand radially while moving axially downstream of the burner into the flame zone. The radial expansion and the bluff body at the tip of the atomizer decreases the pressure at the burner axis so that gases downstream of the burner are drawn axially upstream toward the burner to promote continuous flame ignition and flame stabilization.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A burner for selectively firing on at least oil comprising:

an oil tube for supplying oil for combustion, the oil tube being associated with an oil supply;

a compressed air tube for supplying compressed air at a pressure in the range of about 15 psig to about 100 psig for oil atomization and combustion, the compressed air tube being associated with a compressed air supply;

a primary air passage for supplying primary main combustion air, for combustion, the primary air passage being associated with a main combustion air supply through a main combustion air inlet section, the main combustion air supply supplying main combustion air at a pressure in the range of about 22 osig to about 28 osig;

a compressed air oil atomizer for atomizing oil, the compressed air oil atomizer being located at the downstream end of the primary air passage and nested within the primary air passage, the compressed air tube and compressed air oil atomizer being coaxial in at least a portion of the compressed air oil atomizer;

a plurality of primary swirl vanes in fluid communication with the primary main combustion air so that the primary main combustion air exits the primary air passage with a swirl number above the critical swirl number of 0.6;

a secondary air passage for supplying secondary main combustion air for combustion, the secondary air passage being associated with the main combustion air supply through a main combustion air inlet section and through a damper assembly, the primary air passage being nested within the secondary swirl passage;

a secondary swirl vane assembly for swirling secondary combustion air, the secondary swirl vane assembly being positioned within the secondary air passage;

a secondary air sleeve nested within the secondary air passage and;

the main combustion air inlet section being associated with the main combustion air supply, the damper assembly being nested within the main combustion air inlet section, the damper assembly being adjustable for controlling the rate of flow of main combustion air through the damper assembly to the secondary air passage.

2. The burner of claim 1, wherein the position of the secondary air sleeve is axially adjustable.

3. The burner of claim 2, further including means for adjusting the axial position of the compressed air oil atomizer.

4. The burner of claim 3, wherein the means for adjusting including adjusting nuts attached to the compressed air oil atomizer.

5. A burner for selectively firing on at least oil comprising:

an oil tube for supplying oil for combustion, the oil tube being associated with an oil supply;

a compressed air tube for supplying compressed air at a pressure in the range of about 15 psig to about 100 psig for oil atomization and combustion, the compressed air tube being associated with a compressed air supply;

a primary air passage for supplying primary main combustion air, for combustion, the primary air passage being associated with a main combustion air supply through a main combustion air inlet section, the main combustion air supply supplying main combustion air at a pressure in the range of about 22 osig to about 28 osig;

a compressed air oil atomizer for atomizing oil, the compressed air oil atomizer being located at the downstream end of the primary air passage and nested within the primary air passage, the compressed air tube and compressed air oil atomizer being coaxial in at least a portion of the compressed air oil atomizer;

a plurality of primary swirl vanes in fluid communication with the primary main combustion air so that the primary main combustion air exits the primary air passage with a swirl number above the critical swirl number of 0.6;

a secondary air passage for supplying secondary main combustion air for combustion, the secondary air passage being associated with the main combustion air supply through a main combustion air inlet section and through a damper assembly, the primary air passage being nested within the secondary air passage;

a secondary swirl vane assembly for swirling secondary combustion air, the secondary swirl vane assembly being positioned within the secondary air passage;

a frustro-conical heat shield and flame shaper mounted on a downstream end of the secondary air passage; and a flame shield mounted to an outer surface of the secondary air passage upstream of the frustro-conical heat shield and flame shaper.

6. A method for promoting rapid mixing of fuel and air and for obtaining a stable combustion flame in a burner, comprising:

providing compressed air at a pressure in the range of about 15 psig about 100 psig atomize oil and for combustion;

providing atomized oil for combustion;

providing bluff body recirculation of at least the compressed air and atomized oil;

providing a portion of air for combustion as main combustion air from within the burner, the main combustion air being provided at pressure in the range of about 22 osig to about 28 osig; and inducing a portion of air tar combustion from outside of the burner, wherein the portion of air for combustion from outside the burner comprises about 60 percent to about 70 percent of the air for combustion.

7. A method for promoting rapid mixing of fuel and air and for obtaining a stable combustion flame in a burner, comprising:

providing compressed air at a pressure in the range of about 15 psig to about 100 psig to atomize oil and for combustion;

providing atomized oil for combustion;

providing bluff body recirculation of at least the compressed air and atomized oil;

supplying gas for combustion;

providing a portion of air for combustion as main combustion air from within the burner, the main combustion air being provided at a pressure in the range of about 22 osig to about 28 osig; and inducing a portion of air for combustion from outside of the burner, wherein the portion of air for combustion from outside the burner comprises about 60 percent to about 70 percent of the air for combustion.

* * * * *

UNITED STATES PATENT AND TRADEMARK OFFICE

CERTIFICATE OF CORRECTION

PATENT NO. : 6,969,249 B2
DATED : November 29, 2005
INVENTOR(S) : Marino et al.

It is certified that error appears in the above-identified patent and that said Letters Patent is hereby corrected as shown below:

Column 12,
Line 36, “secondary swirl passage” should be -- secondary air passage --.

Column 13,
Line 33, “100 psig atomize” should be -- 100 psig atomize --.

Column 14,
Line 9, “air tar combustion” should be -- air for combustion --.

Signed and Sealed this

Fourteenth Day of February, 2006

JON W. DUDAS
*Director of the United States Patent and Trademark Office*

UNITED STATES PATENT AND TRADEMARK OFFICE

CERTIFICATE OF CORRECTION

PATENT NO. : 6,969,249 B2
APPLICATION NO. : 10/428494
DATED : November 29, 2005
INVENTOR(S) : Marino et al.

It is certified that error appears in the above-identified patent and that said Letters Patent is hereby corrected as shown below:

Column 12,
Line 36, "secondary swirl passage" should be -- secondary air passage --.

Column 13,
Line 33, "100 psig atomize" should be -- 100 psig to atomize --.

Column 14,
Line 9, "air tar combustion" should be --air for combustion --.

This certificate supersedes Certificate of Correction issued February 14, 2006.

Signed and Sealed this

Fifteenth Day of August, 2006

JON W. DUDAS
*Director of the United States Patent and Trademark Office*